FIP8011 OR 4,036,297

United States Patent [19]

Swihart, Sr.

[11] 4,036,297

[45] July 19, 1977

[54] SUBSURFACE FLOW CONTROL APPARATUS AND METHOD

[76] Inventor: Patrick S. Swihart, Sr., 3507 Baumann, Midland, Tex. 79701

[21] Appl. No.: 702,144

[22] Filed: July 2, 1976

Related U.S. Application Data

[63] Continuation-in-part of Ser. No. 560,350, March 21, 1975, Pat. No. 3,968,839.

[51] Int. Cl.[2] ..... E21B 43/12; E21B 47/06

[52] U.S. Cl. ..... 166/250; 166/314; 166/320; 166/321; 166/325

[58] Field of Search ..... 166/314, 250, 319, 320, 166/321, 322, 325

[56] References Cited

U.S. PATENT DOCUMENTS

| | | | |
|---|---|---|---|
| 2,071,639 | 2/1937 | Long | 166/325 X |
| 2,251,244 | 7/1941 | Stanley | 166/314 |
| 2,351,322 | 6/1944 | Crake | 166/314 X |
| 2,565,742 | 8/1951 | Sailers | 166/319 X |
| 3,025,798 | 3/1962 | Coberly et al. | 166/53 |
| 3,045,759 | 7/1962 | Garrett et al. | 166/320 |
| 3,456,728 | 7/1969 | Chenoweth | 166/320 |
| 3,601,191 | 8/1971 | McMurry et al. | 166/319 |

*Primary Examiner*—Stephen J. Novosad
*Attorney, Agent, or Firm*—Marcus L. Bates

[57] ABSTRACT

A subsurface control which can be installed and retrieved from the interior of a borehole by a wireline. The apparatus is preferably located at the bottom of the borehole and controls the flow of well fluids by a pulse flow-type operation which shuts in the well prior to reaching the critical flow rate, and re-establishes flow after sufficient pressure buildup in the borehole and formation. The apparatus more efficiently utilizes well energy in lifting liquid to the surface of the ground, and includes apparatus which cyclically flows the well in response to flow rate and bottomhole pressure. In one embodiment of the invention, the apparatus is used in combination with a free traveling plunger.

15 Claims, 4 Drawing Figures

SUBSURFACE FLOW CONTROL APPARATUS AND METHOD

CROSS-REFERENCES TO RELATED APPLICATIONS

This application is a continuation-in-part of Ser. No. 560,350, filed Mar. 21, 1974, now U.S. Pat. No. 3,968,839.

BACKGROUND OF THE INVENTION

In my co-pending patent application, Ser. No. 560,350, filed Mar. 21, 1975 now U.S. Pat. No. 3,968,839, of which this patent application is a continuation in part, it is pointed out that there are many hydrocarbon producing wells incapable of sustaining a flow velocity within the production tubing which is in excess of the critical flow rate of the well. Hence the velocity is insufficient to prevent generation of a liquid column or hydrostatic head which accumulates within the production tubing and eventually causes the well to load up. These wells usually are referred to as low volume gas wells or high GOR (gas-oil ratio) oil wells. In such an instance, liquid progressively accumulates within the production string, and eventually the accumulated hydrostatic head will attain a value which essentially "shuts in" or "kills" the well.

Kicking off a dead well is expensive and wasteful, because a technician must blow down the well to atmospheric pressure in order to provide sufficient pressure differential for overcoming the effective hydrostatic head. Sometimes the additional step of "swabbing" is required in order to re-establish the flow.

The present known methods of pulse flowing a low GOR type well is carried out by employing a surface control valve and equipment which utilizes a time cycle or a surface pressure controller. The well is shut in for a finite time interval to enable the downhole formation and borehole to be recharged, whereupon the gas associated with the reservoir is allowed to be compressed to a value which overcomes the hydrostatic head of the wellbore. When the compressed gas is released, the resultant gas expansion establishes a flow rate of a sufficient velocity to unload the accumulated liquids. The well is allowed to flow down to a predetermined rate, whereupon the well is shut in again, and the cycle of operation is repeated.

Pulse flowed, low volume wells must rely upon pressure being effected each flow cycle within the entire tubing string and annulus, which often causes the outflow lines to be momentarily overloaded. Accordingly, this undesirable solution also causes other problems, such as difficulty in correctly attaining proper gas measurements at the meter run, and interference with the operation of other downstream equipment and apparatus.

In the above-noted patent (U.S. Pat. No. 3,968,839), a spring setting on the pilot was employed to set a fixed opening pilot pressure. This expedient fails to take into account the possibility of fluctuating surface line pressure or changes in downhole tubing pressure; and therefore, should the pressure in the line located downstream of the well head change, this change in pressure is reflected on the bottom hole pressure. Therefore, should this downstream pressure change drastically, the set pressure of the pilot could cause the downhole valve device to open at an inappropriate bottom hole pressure differential.

Accordingly, it is desirable to provide the tool of my previous invention with means by which changes in the downstream pressure are taken into account respective to opening of the pilot valve.

Accordingly, it is desirable to have made available a system and method of subsurface well control and operation which is responsive to changes in both surface and subsurface pressures, and which employs a minimum bottom hole pressure differential requirement for producing the well so that an optimum amount of gas and liquid can be attained from the wellbore.

SUMMARY OF THE INVENTION

This invention relates to both method and apparatus for producing a well, and specifically to a subsurface flow controller which can be installed and retrieved by wireline actuated tools. The apparatus is located at the bottom of the borehole in proximity to the casing perforations, and controls flow therethrough and into the production tubing string. The apparatus includes means therewithin which opens a flow valve in response to a predetermined pressure differential measured between the tubing pressure and the downhole pressure, and continues to flow the well until the flow rate therethrough diminishes to a predetermined value, whereupon the apparatus shuts in the well until the production reservoir again charges the borehole annulus with a suitable magnitude of gas pressure.

In one embodiment of the invention, the apparatus is used in combination with a free-traveling plunger device so that the well bore is maintained clean, and the accumulated liquid slug is more efficiently lifted to the surface of the ground.

The flow controller has an axial, fluid conducting passageway formed therein and is sealingly mounted respective to the production tubing string to force any flow which occurs through the production string to also travel through the axial passageway.

The axial passageway is divided into a piston chamber, a production inlet chamber, and a production outlet chamber. The piston chamber has a piston reciprocatingly received therein which divides the chamber into an upper and a lower piston chamber. A pilot valve means, actuated in response to the pressure differential between the tubing and downhole pressures, controls flow of production fluid into the lower piston chamber.

A valve seat separates the production outlet chamber from the production inlet chamber; and, a valve element actuated by the piston controls fluid flow through the axial passageway. Hence upstream and downstream forces act on both the pilot valve and the piston, and by suitably sizing the various springs and ports associated with the apparatus, closure of the controller can be effected responsive to the occurrence of a particular flow rate through the tubing string. This expedient also enables adjustment of the cycle of operation of the device, which can be made to coincide with the critical flow rate of the well to thereby avoid logging.

A primary object of the present invention is to provide a flow control system by which more efficient use of well energy is utilized in lifting formation fluid to the surface of the earth.

Another object of the invention is to provide a more efficient subsurface controller apparatus for producing wells, by utilizing pressure differential across the valve for opening the valve, and the mass flow rate for closing the valve.

A further object of this invention is to disclose and provide a system of operation for producing gas wells by cyclically flowing the well in response to the flow rate and the pressure differential measured between the tubing pressure and the downhole pressure.

A still further object of this invention is to provide a downhole control device which flows a producing well in response to downhole and uphole pressure differential, and reservoir conditions.

An additional object of the invention is to provide both method and apparatus for pulse flowing a well by utilizing pressure differentials between the reservoir and production tubing and a minimum predetermined flow rate for the cyclic operation thereof.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENTS

Figure 1:
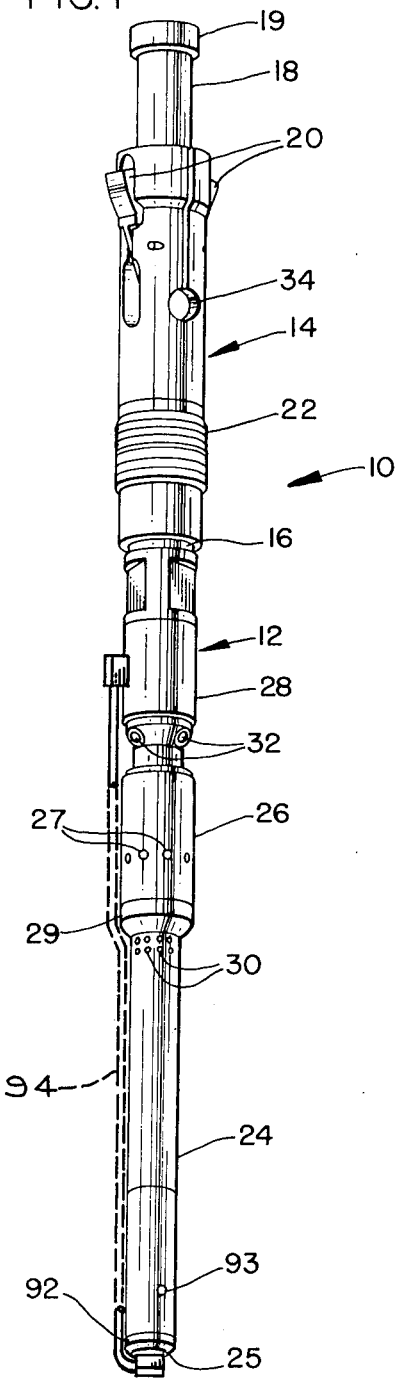
FIG. 1 is a pictorial side view of a control apparatus made in accordance with the present invention.

In FIG. 1 there is disclosed a flow controller means 10 which can be connected to the tubing string of a well bore for controlling production therefrom. The controller in the embodiment of FIG. 1 comprises a valve body assembly 12 connected to a retrievable locking device 14, such as seen in FIG. PF 18 on page 515, Baker Catalog, 1970–71, Baker Oil Tool, Houston, Texas. The body and the locking device threadedly engage one another at 16. A fishing neck 18 defines the upper extremity 19 of the apparatus, while radially disposed latches 20 enable the tool to be landed on a landing nipple and latched into position by utilizing techniques known to those skilled in the art. Seals 22 prevent fluid flow externally about the apparatus so that produced fluid is forced to flow internally through the tool.

The lower marginal terminal end of the controller comprises a sensor element 24 having a lowermost end portion 25. As best appreciated from viewing FIGS. 3 and 4, together with other figures of the drawings, a piston chamber is formed within member 26, and the chamber is communicated with the lower borehole by means of radially spaced, horizontally disposed bleed ports 27.

A main production inlet chamber forming portion 28 of the main body is joined to a piston chamber forming portion of the body by the illustrated reduced diameter inlet section of the apparatus. The lower end of the position section is reduced in diameter at 29 and spaced therefrom are a series of radially spaced-apart pilot valve inlet ports 30.

Radially spaced-apart main flow inlet ports 32, hereinafter called chokes, are spaced from a series of outflow ports 34, with the before mentioned seals 32 being interposed between the ports 34 and the threaded end 16.

Figure 2:
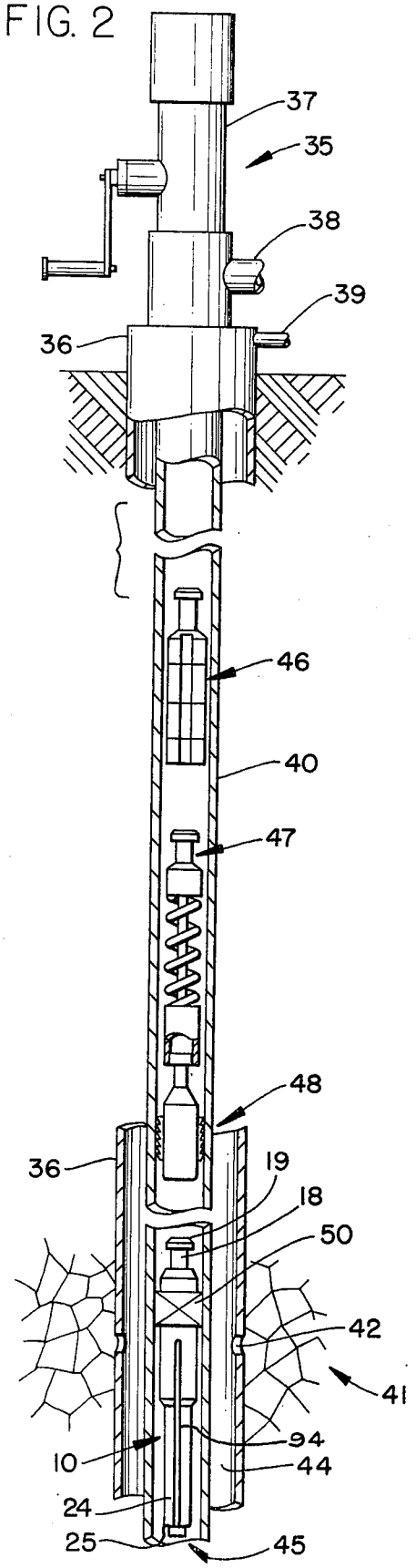
FIG. 2 is a diagrammatical representation of a wellbore having apparatus disposed therein which enables several different ones of the embodiments of the present invention to be practiced.

Looking now specifically to the details of FIG. 2, there is schematically or diagrammatically illustrated a wellhead 35, sometimes called a christmas tree. The wellhead is supported by a casing 36, from which there upwardly depends a lubricator 37, known to those skilled in the art. Production outlet 38 is connected to the usual tank farm by a gathering system, while the casing annulus is provided with the usual piping 39.

Production tubing string 40 communicates with the lubricator and production outlet pipe and extends downhole in underlying relationship respective to the fluid level provided by a production formation 41. A series of perforations 42 communicate the formation with the casing or borehole annulus 44. Hence fluid flow from the formation occurs in a manner indicated by the arrow at numeral 45.

In one preferred embodiment of the invention, there is reciprocatingly received within the upper marginal portion of the production tubing a free-traveling plunger 46. A plunger stop or bumper 47 is anchored at 48 to the interior of the tubing string. The apparatus 46–48, along with the lubricator, can be made in accordance with the Gregston U.S. Pat. No. 3,473,611.

A packoff 50, which preferably includes a landing nipple, enables the apparatus of the invention to be installed and retrieved by wireline operation in a manner known to those skilled in this particular art. The packoff forces fluid to occur only through the controller of this invention.

Figure 3:
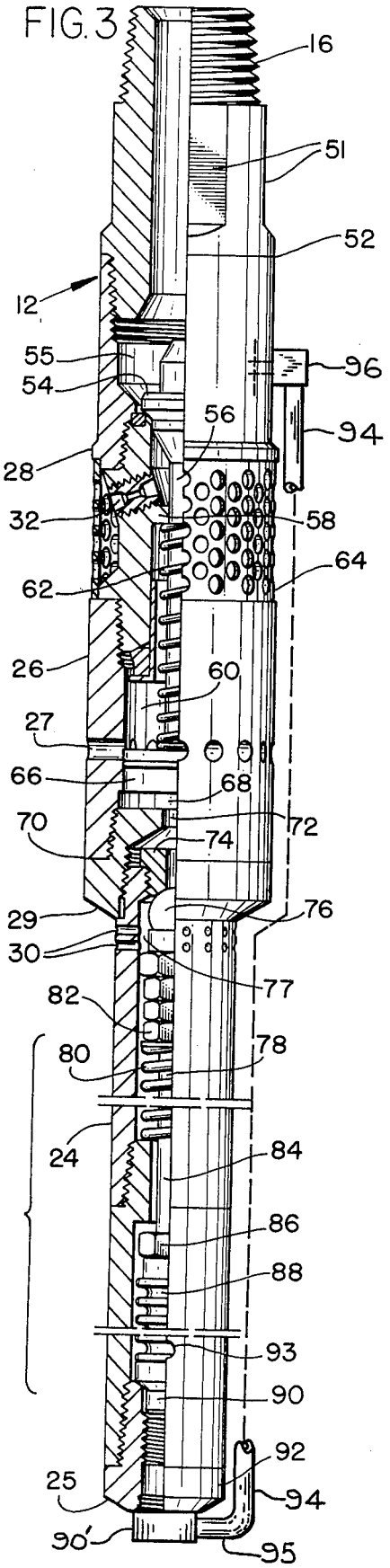
FIG. 3 is a longitudinal, part cross-sectional view of part of the apparatus disclosed in FIGS. 1 and 2; and, FIG. 4 is a part-diagrammatical, part-schematical representation of the apparatus disclosed in FIG. 3, which enables the theory of operation thereof to be better appreciated.
Figure 4:
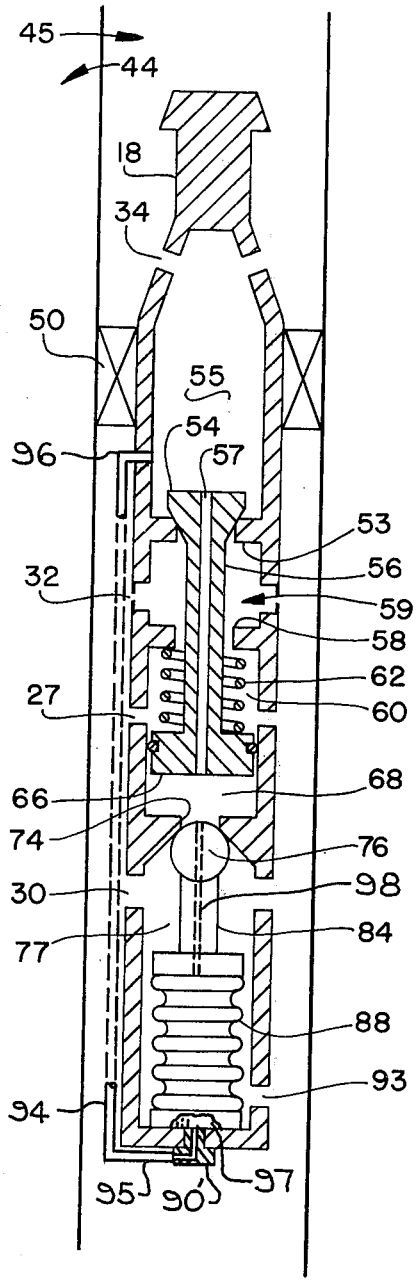

Looking now more particularly to the details of FIGS. 3 and 4, the flow controller according to the present invention is seen to comprise a main body having wrench flats 51 formed on the illustrated sub, with interface 52 being effected by the mating of the sub and the remainder of the tool. A production valve seat 53 sealingly receives a production flow control valve element 54 and controls fluid flow through a production outflow or outlet chamber 55.

Valve stem 56 is provided with an axial passageway 57, which is co-extensive with the valve face and valve stem. The valve stem extends through a shoulder 58 which defines the lowermost portion of the production inlet chamber 59.

An upper piston chamber 60 receives a compression spring 62 therein. Screen 64 circumferentially extends about the reduced diameter, choke receiving portion of the apparatus. Piston 66 divides the piston chamber into the before mentioned upper and the illustrated lower piston chambers 60 and 68, with an interface 70 defining the lower edge portion of the piston chamber forming portion of the main body.

Axial flow port 72 defines the lower extremity of the lower piston chamber and is in fluid communication with a pilot ball seat 74. A pilot ball valve element 76 controls flow from pressure sensor chamber 77 and is connected to a bellows 88 by means of a pilot valve shaft 78. Pilot valve spring 80 is provided with adjustment nuts 82 so that the biasing force thereof can be adjusted. The pilot valve shaft continues at 84 where it threadedly engages nut 86 of the pressure actuated or pressure responsive bellows. The end 90 of the bellows is seated in the illustrated manner of FIG. 3 and secured within the tool by a lower end portion 92 of the tool. A weep hole 93 eliminates debris from the bellows annulus and contributes to effecting bottomhole pressure upon the bellows.

The plug 90' is attached to one end 95 of a small $\frac{1}{8}$ inch i.d. tubing 94. The tubing extends to a connector 96 which connects the remaining tubing end to the outflow chamber. This expedient effectively causes the production tubing pressure above the main valve to be effected within the interior 97 of the bellows. Accordingly, elements 90', 94, 95, and 96 of the invention provide a flow passageway means by which the pressure upstream of the valve is connected to the pilot valve actuator. This expedient enables the pilot valve to always compensate for changes in the tubing pressure above the valve. Hence if the pressure at 55 varies, the pilot opening pressure requirement also varies.

The bellows is arranged respective to shaft 84 in such a manner that increased bottomhole pressure moves the shaft in a downward direction, thereby unseating the ball from the ball seat. It will be noted that like or similar numerals, wherever possible, relate to like or similar numerals throughout the figures of the drawings.

As best understood by studying FIGS. 1 and 2, the present invention is installed on the illustrated landing nipple by engaging the fishing neck of the controller assembly with a wireline actuated fishing tool and running the controller downhole until it is sealingly received in a seated manner within the packoff device 50. Where a free plunger is used in conjunction with the controller, the plunger bumper is next wireline installed in a similar manner and thereafter a free-traveling plunger dropped through the lubricator, after which the lubricator is capped and the well is ready to be put into production.

As the hydrocarbon producing formation produces fluid, both liquid and gas will accumulate downhole. The liquid will rise within the annulus, while at the same time, the gas pressure within the annulus will increase. It will be noted during this stage of the shut-in operation that both the pilot and the main flow valves are seated; and accordingly, downhole pressure is effected on the exterior of the bellows 88 by means of port 30 or 93, while uphole pressure is effected on the interior of the bellows by means of tubing 94. Spring 80 maintains the ball valve sealingly engaged against its seat, while spring 62 biases piston 66 in a downward direction, thereby maintaining the valve element 54 sealingly engaged against its corresponding seat. Furthermore, the tubing pressure uphole the packer device 50 is at a reduced pressure, depending upon the pressure effected within the outflow line 38, and the hydrostatic head of any fallback liquid.

The closing force of the pilot valve assembly is comprised of the bottomhole pressure at 55 which is introduced in the bellows by tube 94, plus the force of the pilot valve spring 80. Should the pressure of the flow lines downstream of the wellhead change, this will be reflected on the tubing pressure at 55 to thereby change the pressure differential across the bellows while the spring setting of 80 always remains at a fixed differential value which is sufficient to unload the well.

When the downhole pressure below the controller, as for example, the formation pressure, reaches a predetermined set pressure, the aggregate compressive forces of spring 80 and the bellows pressure will be overcome, thereby progressively unseating the pilot or ball valve from its attendant seat. Usually, liquid will have accumulated above the casing perforations; and accordingly, liquid fluid flow will now occur into port 30, through valve seat 74, into lower piston chamber 68, where the pressure thereof is effected against the lower surface of the piston. This action activates the piston and opens the main valve, thereby unloading fluid which had been charged into the borehole and formation.

Should a plunger device be included in the combination, this sequence of events causes liquid to rise above the plunger, which presently remains seated against the bumper assembly 47. The previous fallback liquid resulting from the previous cycle of operation will comingle with the new production fluid. As the downhole pressure progressively increases, the bellows will continue to move the pilot valve shaft in a downward direction until the pressure within chamber 68 reaches a value whereby the pressure differential across the valve 54 will cause the piston 66 to move in an upward direction. As the piston moves, valve 54 is unseated from its corresponding seat 53, thereby allowing fluid to flow through the chokes, through the production inlet chamber, through the production valve seat, into the production outlet chamber 55, through the outlet production ports 34, and up through the tubing string. Flow across the valve seat 53 reduces the pressure within chamber 59, and as the piston covers the pilot ports 27, a sudden pressure differential across the piston is effected, thereby driving the piston in an upward direction with a snap action. As the piston moves above an uncovers ports 27, the entire bottomhole pressure is effected against the lower face of the piston; and consequently, the pressure drop across the piston now equals the pressure differential measured between the well bottomhole and the interior of the tubing string. The compressed gas within the borehole and formation causes an inrush of flow to occur through the chokes, through the main valve, and up the tubing string, carrying therewith the traveling plunger, the slug of liquid, and produced gas.

Gaseous production, along with any entrained liquid, continues in this manner until the bottomhole pressure diminishes to a preset value, which preferably is in excess of, but close to, the critical flow value of the well. At some preselected, reduced set pressure, the bellows 88 moves shaft 84 in an uphole direction to seat the ball valve; however, the pressure within the chamber 68 will not be reduced at this time, because the piston 66 is above the ports 27; and therefore, the piston pressure differential remains dependent upon the above stated variables. As the pressure drop across the piston diminishes to some preselected value, it will be forced by the compression spring 62 back into the illustrated position of FIGS. 4. This expedient causes the main flow valve to close with a snap action; whereupon the well is shut in for a length of time which is dependent upon the spring force, whereupon the controller is in standby configuration awaiting pressure buildup to cause the next cycle of operation to commence.

Those skilled in the art, having digested the foregoing portions of this disclosure, will appreciate that the selected spring forces 62 and 80, along with the choke size 32, the size of the orifice or flow passageway 57, together with the relative areas of the opposed sides of the piston can be correlated respective to one another to cause the main flow valve to open at any set downhole pressure and to cause the flow valve to close at any selected, reduced flow rate through the apparatus. Closure of the main flow valve should be set to occur at or above the critical flow rate, of course. As indicated above, the pilot section of the controller opens on any preset differential pressure and closes at some reduced differential pressure after providing the function of opening the main flow valve. The main flow valve, once it has opened, remains open regardless of the position of the pilot section until the flow rate through the controller reduces to a value which moves the piston against the biasing force of spring 62 to a position which closes the main flow valve. Hence it may be said that the main flow closes on any preset flow rate to shut in the well for a time interval which is determined by the rate of downhole pressure buildup. In other words, a selected downhole pressure differential indirectly opens the main flow valve, while a selected low flow rate through the tool closes the main flow valve, with these conditions of operation being sensed downhole adjacent to the production formation. The controller can be anchored in a sealing manner downhole by using a landing nipple, a packoff device, or any other desired expedient, so long as flow occurs through the controller in the above illustrated manner.

While the present invention finds maximum utility in weak wells having a large GOR which must be stopcocked or pulse flowed, it can also be used in any fluid producing well as a means of controlling the production rate, regardless of the GOR.

It is evident that the present invention is opened in response to a selected maximum downhole formation pressure differential being generated, and the well is shut in upon any selected minimum flow rate, which usually will be a flow rate which is close to, but greater than, the critical flow rate of the well. The shut in period of the cyclic operation enables formation fluid from the production zone to accumulate downhole in the borehole. The critical flow rate as used in this disclosure is intended to include a rate of flow for a given well where insufficient velocity through the tubing string is available to carry liquid to the surface by entrainment; and accordingly, liquid has commenced to accumulate downhole in the tubing string and within the casing, and the liquid hydrostatic head ultimately reaches a value to render the well dead if production is continued.

An important aspect of the present invention is in the standing valve action of the controller. Fallback of liquid during each cycle of operation is prevented from flowing back into the causing annulus and effectively increasing the hydrostatic head; and accordingly, efficiency of operation is greatly improved by the "standing valve action" of the present invention. The present invention provides further advantages in that all of the pressure from the reservoir is maintained below the liquid slug; thereby enabling the well energy to be utilized in lifting the slug of liquid to the surface of the earth. This advantage is not realized with a surface type controller.

The present invention completely eliminates all requirements for any surface control equipment, and in most cases plungers, by the provision of a downhole controller which senses tubing pressure, downhole pressure, and downhole flow rates in proximity of the production zone, and regulates the flow of production fluid according to selection of optimum downhole operating variables. By controlling liquid accumulation within the borehole, the well production can be carried out with lower pressure differentials than is possible with surface type controls or plungers.

As diagrammatically illustrated in FIG. 4, the passageway connecting the chamber 55 to the interior 97 of the bellows can be realized by the substitution of an internal passageway 98 for the external passageway 94. The passageway 98 is drilled through the ball 76, into the shaft 74, 84, and into the interior of the bellows. The longitudinal axial passageway 98 is therefore aligned along the longitudinal axis of the controller.

The external passageway 94 is preferred because of the likelihood of debris causing stoppage of the entrance thereof at 76.

Moreover, still another alternate form of effecting the passageway for connecting chambers 55 and 98 together is the provision of an internal passageway which leads from chamber 55, into the siewall structure of the main valve body, and down the tool into communication with the interior of the bellows.

The size of the tubing 94 and the fitting 96 must present a maximum cross-section which admits the lower marginal end of the valve body to travel through the seating nipple so that the seals 22 and latches 20 are properly received in sealed anchored relation downhole in the borehole.

I claim:

1. In a borehole having a fluid producing formation location downhole therein, and a production tubing extending downhole into proximity of the formation, with the tubing forming a produced fluid flow path and a borehole annulus, the improvement comprising:

a subsurface flow controller for controlling flow of fluid from the formation into the tubing string, said controller being in the form of a fluid conducting hollow body and having an upper and lower end portion, said hollow body having means forming a piston chamber, a production inlet chamber, and a production outlet chamber therewithin;

said piston chamber having a piston reciprocatingly received therewithin and dividing the last said chamber into an upper and lower piston chamber;

a pilot valve, means by which said pilot valve is actuated in response to the pressure differential between the bottomhole pressure and the tubing pressure above the tool to thereby control the flow of produced fluid into and out of said lower piston chamber;

a production valve seat separating said production outlet chamber from said production inlet chamber, a production valve element having means by which it is actuated by said piston from an opened to a closed position for controlling fluid flow through said production valve seat; a choke forming a produced fluid inlet into said production inlet chamber; means forming a bleed port which is arranged respective to the piston so that downhole pressure is effected within said upper piston chamber when said production valve is closed and which is effected within said lower piston chamber when said production valve is moved to the open position; and means biasing said production valve element towards the closed position;

so that increased bottomhole pressure opens said pilot valve to cause said piston to open said production valve element, and fluid flow can occur through said production valve seat until a reduced flow rate through the last said seat causes the production valve element to assume a closed position.

2. The improvement of claim 1 and further including means forming a passageway through said valve element for flow connecting said production outlet chamber and said lower piston chamber so that flow can occur therebetween when flow occurs through said pilot valve.

3. The improvement of claim 2 wherein said pilot valve includes means by which it is adjustably spring loaded towards the closed position so that the opening force can be regulated.

4. The improvement of claim 1 wherein said pilot valve has a pressure sensor connected thereto for actuation thereof, to cause said pilot valve to open in response to increased pressure being effected downhole by the formation.

5. The improvement of claim 1, and further including means by which said pilot valve is adjustably biased towards the closed position so that the opening force can be regulated;

and a pressure sensor having means connected to said pilot valve to cause said valve to open in response to increased downhole pressure.

6. The improvement of claim 1 and further including means forming a passageway for connecting together said production outlet chamber and said lower piston chamber so that flow occurs therebetween when said pilot valve is open;

said pilot valve having means by which it is adjustably spring loaded toward the closed position so that the opening force thereof can be regulated.

7. The improvement of claim 1 wherein said pilot valve is spring loaded toward the closed position so that the opening force thereof can be regulated;

a pressure sensor, including a bellows having means by which it is connected to open said pilot valve upon the exterior of the bellows reaching an increased pressure; means forming a flow passageway from said overflow chamber into the interior of the bellows;

and an orifice means for connecting said production outlet chamber and said lower piston chamber together in fluid flow relationship so that flow can occur therebetween when said pilot valve is moved to the opened position.

8. The improvement of claim 1 and further including a traveling plunger means positioned within the production tubing at a location above said controller; a plunger arrester, a plunger lubricator, said plunger arrester being anchored above said controller and below said plunger in spaced relationship to said lubricator, said lubricator being affixed to an upper end portion of said tubing string;

so that said controller can cause said plunger to travel uphole into the lubricator when sufficient downhole pressure is effected thereon.

9. Method of controlling mixed liquid and gaseous fluid flow from a producing formation located downhole in the borehole, wherein the produced fluid flows uphole through a production tubing string, comprising the steps of:

1. locating a flow controller downhole in a borehole in proximity of the production formation;
2. connecting the flow controller to the tubing string so that fluid flow through the tubing string is controlled by the action of the controller;
3. sensing the pressure differential between the formation pressure and tubing pressure, and moving the controller to a fluid flow position in response to the bottomhole pressure increasing to a value which will expel most of the accumulated liquid from the borehole;
4. sensing the flow rate through the tubing string and moving the controller to a position to prevent fluid flow through the tubing string in response to the flow rate decreasing to a value which is in excess of a rate of flow where insufficient velocity through the tubing string is available to carry liquid to the surface by entrainment.

10. The method of claim 9 and further including the steps of initially providing a small flow path for liquid flow through the controller, and thereafter providing a large flow path for mixed gaseous and liquid flow.

11. The method of claim 9 and further including the steps of:

5. positioning a traveling plunger above the controller so that the plunger can aid in lifting fluid uphole through the production tubing string.

12. The method of claim 9 and further including the steps of:

5. providing an initial small flow path for liquid flow through the controller and thereafter providing a large flow path through the controller for mixed gaseous and liquid flow; and,
6. positioning a traveling plunger above the controller so that the plunger can aid in lifting formation fluid through the production tubing string.

13. Method of producing a well which produces mixed gaseous and liquid fluid through a tubing string by cyclically opening and closing the tubing string to flow therethrough according to the following steps:

1. producing the well through the tubing string while sensing the flow rate downhole in the borehole;
2. closing the tubing string to flow when the flow rate therethrough has decreased to a value which tends to accumulate liquid therewithin;
3. sensing the tubing pressure at a location above the formation and the formation pressure at a location downhole in the borehole;
4. continuing the shut-in condition of the borehole until the pressure differential of the formation and tubing pressures indicate that sufficient pressure has accumulated in the borehole annulus to expel substantially all accumulated liquid therefrom when the tubing string is again opened to flow;
5. repeating steps (1) through (4) so that the well is cyclically produced.

14. The method of claim 13 wherein the flow through the tubing is controlled according to the following steps:

5. placing a flow controller in series flow relationship respective to the tubing string;
6. carrying out step (3) by sensing the formation pressure at a location between the controller and the formation, and sensing the tubing pressure between the controller and the interior of the tubing.

15. The method of claim 13 wherein step (2) is carried out by:

7. sensing the flowing pressure differential between the bottomhole pressure and the tubing string pressure and closing the tubing string to flow when the pressure differential is reduced to a value indicative of the flow rate set forth in step (2).

* * * * *

UNITED STATES PATENT OFFICE

CERTIFICATE OF CORRECTION

PATENT NO. : 4,036,297

DATED : July 19, 1977

INVENTOR(S) : PATRICK S. SWIHART, SR.

It is certified that error appears in the above-identified patent and that said Letters Patent are hereby corrected as shown below:

Column 1, line 8, substitute --1975-- for "1974";

Column 4, line 5, substitute --22-- for "32";

Column 6, line 30, substitute --and-- for "an";

Column 9, line 36, substitute --outflow-- for "overflow";

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*